United States Patent [19]

Satchell

[11] Patent Number: 4,809,476

[45] Date of Patent: Mar. 7, 1989

[54] METAL FRAMED WALL STRUCTURE

[75] Inventor: Ronald N. Satchell, Cabramatta, Australia

[73] Assignee: Onteam Limited, London, England

[21] Appl. No.: 193,127

[22] Filed: May 5, 1988

Related U.S. Application Data

[63] Continuation of Ser. No. 816,804, Jun. 7, 1986, Pat. No.

[30] Foreign Application Priority Data

Jan. 17, 1985 [NZ] New Zealand ..... 210863

[51] Int. Cl.[4] ..... E04C 2/38

[52] U.S. Cl. ..... 52/241; 52/656; 52/731

[58] Field of Search ..... 52/241, 242, 243, 666, 52/731, 290, 656

[56] References Cited

U.S. PATENT DOCUMENTS

| | | | |
|---|---|---|---|
| 2,088,781 | 8/1937 | Folsom | 52/290 |
| 2,105,771 | 1/1938 | Holdsworth | 52/241 |
| 2,950,789 | 8/1960 | Davis, Jr. et al. | 52/731 |
| 3,332,197 | 7/1967 | Hinkle | 52/731 |
| 3,423,896 | 1/1969 | Widerby | 52/241 |
| 3,536,345 | 10/1970 | Leifer | 52/735 |
| 3,680,271 | 8/1972 | Satchell | 52/241 |
| 3,845,601 | 11/1974 | Kostecky | 52/241 |

FOREIGN PATENT DOCUMENTS

| | | | |
|---|---|---|---|
| 157312 | of 1922 | United Kingdom | 52/693 |
| 587047 | 4/1947 | United Kingdom . | |

OTHER PUBLICATIONS

U.S. Gypsum, *Steel Framing Components & Accessories for Drywall, Plaster, & Load-Bearing Const.*, 1983, p. 6.

*Primary Examiner*—David A. Scherbel
*Assistant Examiner*—Caroline D. Dennison
*Attorney, Agent, or Firm*—Ladas & Parry

[57] ABSTRACT

A building wall frame structure which is formed from metal and which is intended for assembly by relatively unskilled labor at a construction site. The structure comprises upper and lower horizontally disposed wall plates and a plurality of vertically extending studs interconnecting the wall plates. The upper and lower wall plates are identical and each is in the form of a generally U-shaped channel having side walls, a base wall which interconnects the side walls and a plurality of paired inwardly directed tabs arrayed along each of the side walls. The studs have a C-shaped section which has a width equal to the spacing between the side walls of the plates and the terminal ends of the studs are fitted within the channels defined by the plates. Each stud has a thickness which is approximately equal to the center spacing between adjacent tabs on the wall plates and each stud is formed with notches in each of its corners adjacent the terminal ends of the stud. The notches are provided so that, when the ends of each stud is located within an associated one of the plates, the notches are engaged and the stud is constrained against movement by four adjacent ones of the tabs.

13 Claims, 7 Drawing Sheets

METAL FRAMED WALL STRUCTURE

This is a continuation of co-pending application Ser. No. 816,804 filed on Jan. 7, 1986, abandoned.

FIELD OF THE INVENTION

This invention relates to structural elements for use in metal-framed buildings and, in particular, to a metal wall framing structure for a building.

BACKGROUND OF THE INVENTION

With the ever increasing cost of timber, the construction of domestic dwellings using timber-framed wall structures is causing a heavy financial burden to be imposed on new home buyers. Additionally, because of the high cost of labour required for the fabrication of timber-framed structures, there is a growing need for framing of a type which can be erected, using relatively simple assembly techniques, by non-specialised labour.

Past attempts have been made to meet these problems with the development of various types of metal-framed building structures, but such structures almost inevitably have proved to be more expensive than conventional timber framing. Consequently, the metal-framed structures have been employed predominantly under conditions where it has not been employed predominantly under conditions where it has not been convenient to erect timber structures or where other factors have outweighed financial considerations.

Three different types of metal-framed structures have been developed to this time; all-welded structures which are constructed in factory situations and which are then transported as complete sub-assemblies to sites of intended use, wall frames which are fabricated in factories other than by welding and which are constructed from large numbers of separate components to meet specific requirements, and so-called knock-down wall frames which are assembled at building sites and which desirably use a minimum number of separate components.

The present invention is directed to metal wall framing elements of a type which permit the erection of knock-down frames at a price which, having regard to other factors, is competitive with timber frames. This is achieved by the provision of a system which uses a relatively small number of separate component parts, and by interconnecting the component parts in such a positive way that the need for substantial bracing elements is minimized.

SUMMARY OF THE INVENTION

In its broadest form the invention provides a metal wall framing structure for a building and which comprises a top plate, a bottom plate and a plurality of wall studs interconnecting the top and bottom plates. The top and bottom plates are substantially identical and each is in the form of a generally U-shaped channel having side walls, a base wall which interconnects the side walls and a plurality of paired inwardly directed tabs arrayed along each of the side walls. The studs each have a generally C-shaped section which has a width approximately equal to the spacing between the side walls of the plates whereby terminal ends of the studs may be nested within the channels defined by the plates. Also, each stud has a thickness which is approximately equal to the centre spacing between adjacent tabs and each stud is formed with notches in each corner thereof adjacent the terminal ends of the stud. The notches are positioned such that, when the end of each stud is located within an associated one of the plates, the notches are engaged and the stud is constrained against movement by four adjacent ones of the tabs.

PREFERRED FEATURES OF THE INVENTION

The side legs and connecting wall of each stud preferably are fluted in the longitudinal direction of the stud, in order to increase the rigidity and bending strength of the stud. Moreover, the C-shaped section of each stud preferably is slightly asymmetrical and is formed so that one stud may be inverted relative to another and be fitted to the other in a manner to form a box-section stud.

All of the tabs on each side wall of the top and bottom plates preferably are spaced apart by an equal distance, equal to the thickness of the studs, in order that two or more studs may be positioned in back to back relationship and be held captive by the top and bottom plates.

The base wall of the top and bottom plates preferably is slotted at spaced intervals to accommodate upwardly projecting tongues of members which may be provided for joining aligned or intersecting top and bottom plates.

The invention will be more fully understood from the following description of a preferred embodiment of a metal wall-framing system as shown in the accompanying drawings.

DETAILED DESCRIPTION OF THE INVENTION

Figure 10:
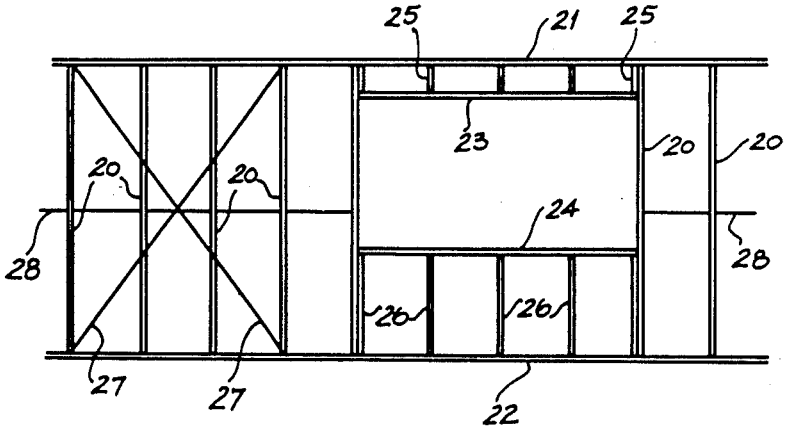
FIG. 10 shows a side elevational view of a typical metal-framed wall having a window opening.
Figure 11:
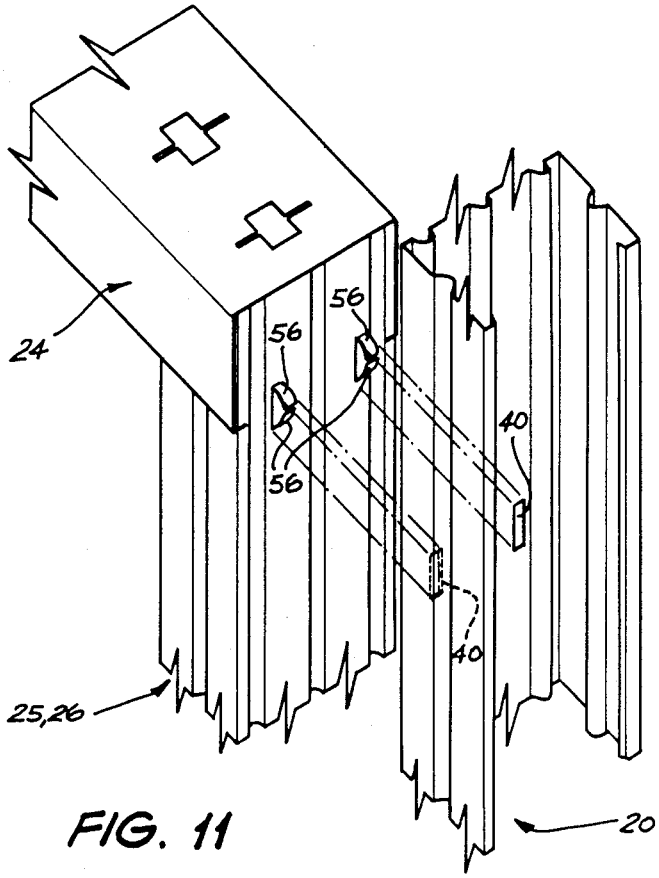
FIG. 11 shows a method of interconnecting wall plate, trimmer stud and wall stud members of the wall frame shown in FIG. 10.
Figure 12:
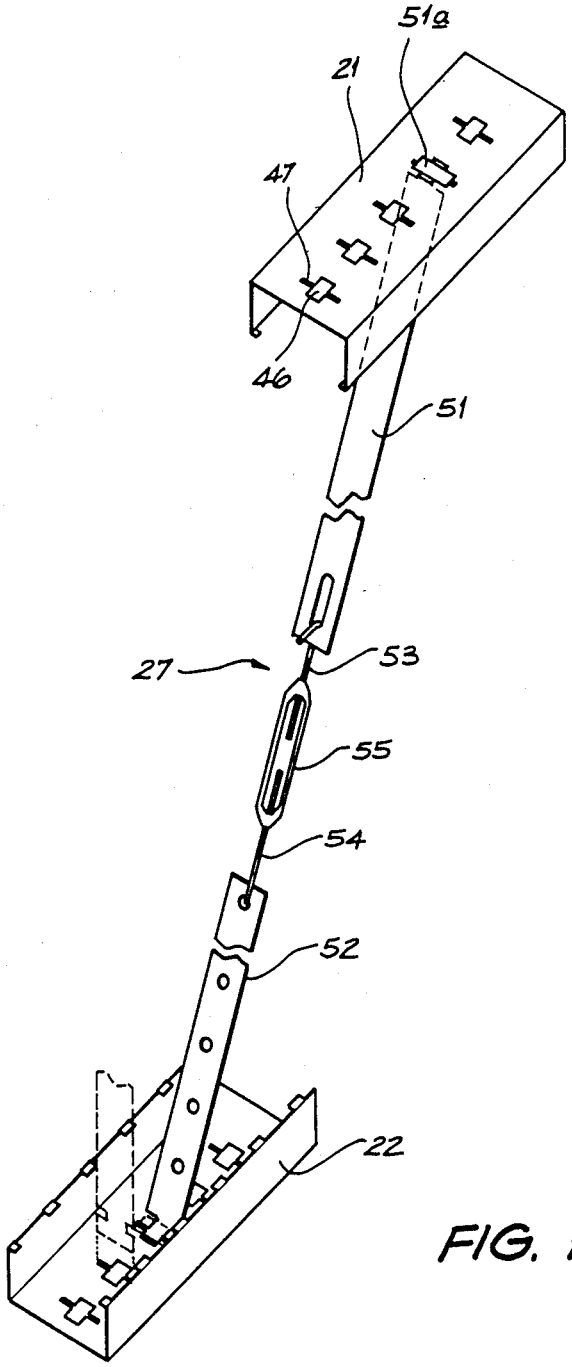
FIG. 12 shows a method of bracing top and bottom plate members of the wall frame shown in FIG. 10.
Figure 13:
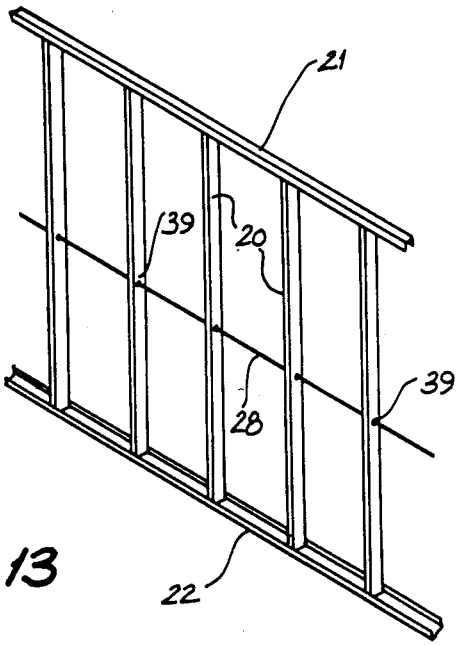
FIG. 13 illustrates a portion of the wall frame in perspective, with a noggin strap being shown connecting the wall studs.
Figure 14:
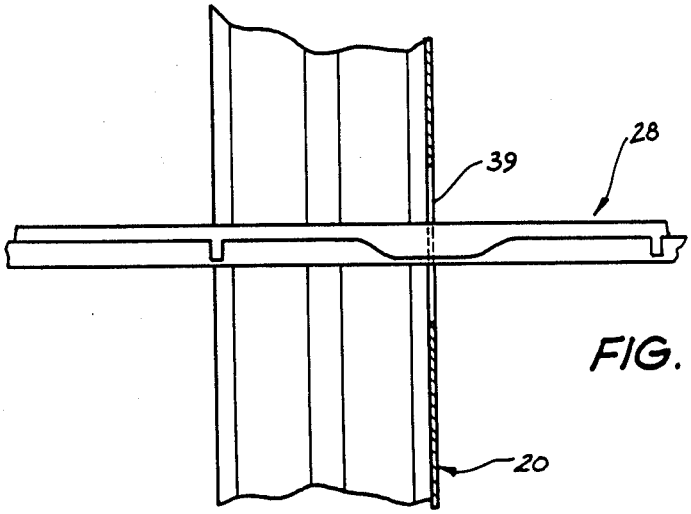
FIG. 14 shows a sectional elevation view of one wall stud with a noggin strap passing therethrough.
Figure 15:
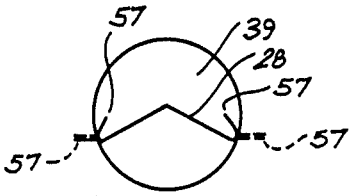
FIG. 15 shows an end elevation view of the noggin strap in position in a hole in the wall stud.

A typical metal wall framing structure is shown in FIG. 10 of the drawings and it comprises:

(a) wall studs 20 which are shown in greater detail in FIGS. 1 to 4, (b) top and bottom wall plates 21 and 22 which are, in fact, inverted forms of one and the same element which is shown in greater detail in FIGS. 5 to 7 and 9, (c) top and bottom window plates 23 and 24 which comprise shortened forms of the wall plate 22, (d) trimmer studs 25 and 26 which are shown in greater detail in FIG. 11, (e) wall braces 27, one of which is shown in detail in FIG. 12, and (f) a noggin strap 28 which is detailed in FIGS. 13 to 15.

The various elements are described in greater detail as follows.

Each wall stud 20 has a longitudinal length corresponding approximately to the floor-to-ceiling height of a room, typically 2.5 meters, and it is formed with a generally C-shaped section. Thus, as best seen from FIGS. 2 to 4, the wall stud has a first (shorter) leg 30, a second (longer) leg 31, a connecting wall 32, a first (shorter) flange 33 and a second (longer) flange 34.

Three longitudinally extending flutes 35 are formed in the wall 32 and similar flutes 36 and 37 are formed in the legs 30 and 31.

Figure 1:
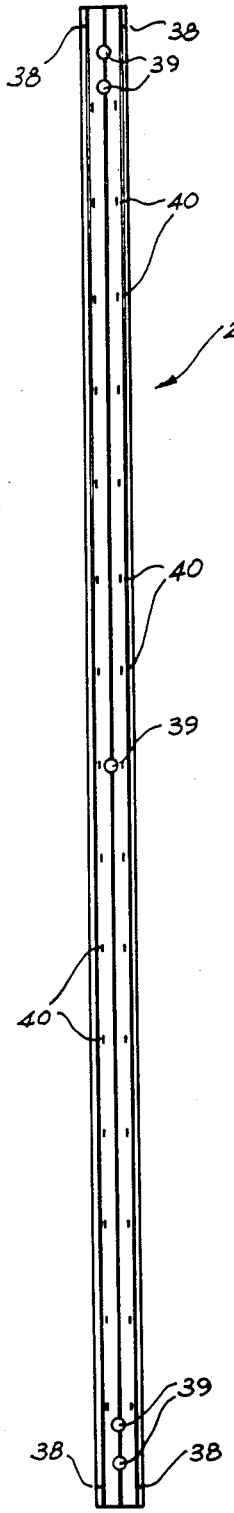
FIG. 1 shows an elevation view of a wall stud as seen in the direction of arrow "A" shown in FIG. 2.
Figure 2:
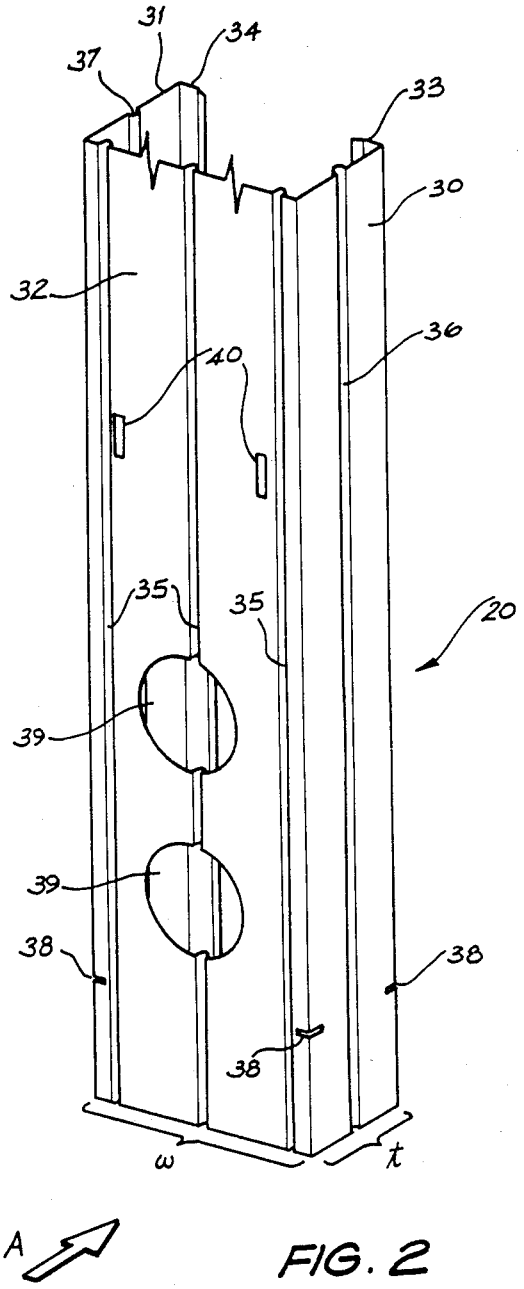
FIG. 2 shows a perspective view of a lower end portion of the wall stud illustrated in FIG. 1.
Figure 3:
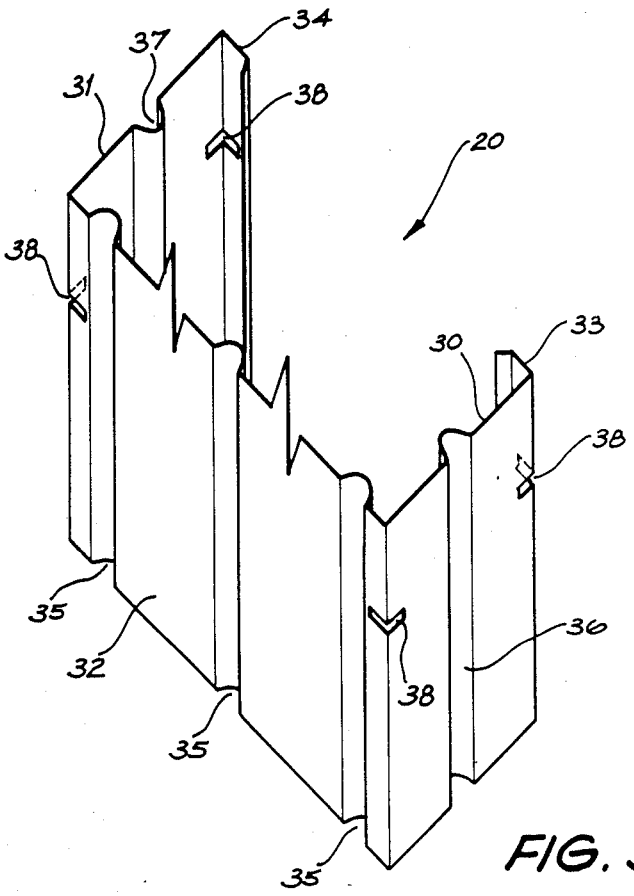
FIG. 3 shows a slightly more detailed perspective view of the lower portion of the wall stud of FIG. 1 and, in particular, shows notches which are formed in corners of the wall stud adjacent its lower terminal end.
Figure 4:
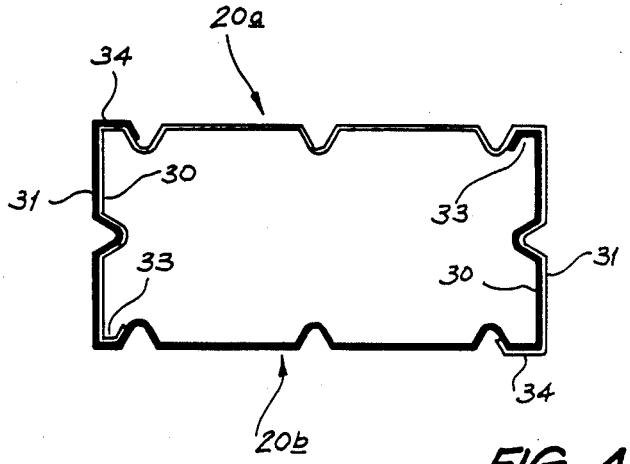
FIG. 4 shows a plan (i.e., sectional end view) of two of the wall studs when interconnected to form a box-section stud member.

The stud has an asymmetrical cross-sectional configuration, and the shorter elements 30 and 33 of the stud are dimensioned to fit within the corresponding longer elements 31 and 34, so that, as shown in FIG. 4, two of the studs 20*a* and 20*b* can be fitted together to form a box-section stud for use where greater-than-normal load bearing capacity is required. The stud 20*b* is shown in solid line in FIG. 4 so that its relationship with stud 20*a* can be clearly seen.

The flanges 33 and 34 of each stud are disposed in a direction generally parallel to the connecting wall 32, but the flanges each have a free edge which tuns inwardly in a direction toward the connecting wall 32 of the stud. When two of the studs are fitted together as shown in FIG. 4, to form a box-section stud, the free edge which is associated with the longer flange 34 of each stud locates in one of the flutes 35 in the connecting wall of the other stud. Thus, the two studs interengage and are held captive to one another.

A particularly important feature of the wall stud resides in the provision of notches 38 adjacent the upper and lower terminal ends thereof. As can best be seen from FIG. 3, one notch 38 is formed in and extends around each corner of the stud, and the notches are provided in order that the studs may be held captive to the top and bottom wall plates 21 and 22.

Other features of the stud are apertures 39 and slots 40 which are formed within the wall 32 of the stud. the apertures 39 are provided to accommodate electrical wiring which frequently is located within the framed wall of a building and to facilitate interconnection of the studs by the noggin strap 28. The slots 40 provide for connection of the trimmer studs 26 to the wall studs.

Figure 5:
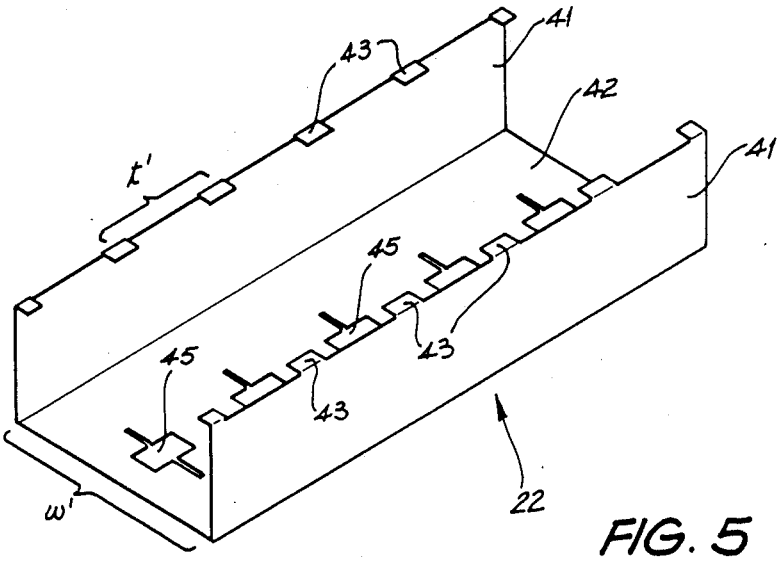
FIG. 5 shows a perspective view of a portion of a length of a bottom plate, a top plate being identical with the bottom plate but being inverted in use.
Figure 6:
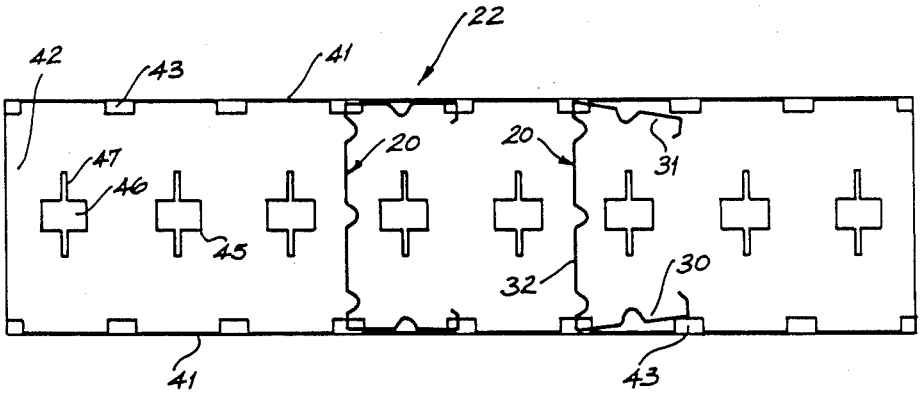
FIG. 6 shows a plan view of a bottom plate with a wall stud being shown (a) being positioned and (b) in position.
Figure 7:
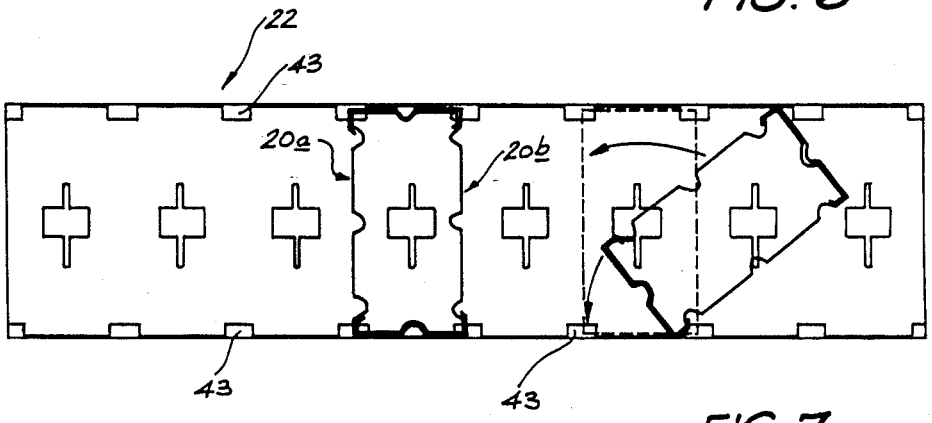
FIG. 7 shows a view similar to that of FIG. 6 but with a wall stud in the form of a box-section being fitted to a bottom plate.

The top and bottom wall and window plates 21, 22, 23 and 24 are all constituted by one and the same element, and such element (identified by numeral 22 and referred to as a wall plate) is detailed in FIGS. 5 to 7.

As illustrated, the wall plates 22 comprises a U-shaped channel having side walls 41 and a base wall 42 which interconnects the side walls. Also, the side walls are formed with a plurality of arrayed, paired, inwardly directed tabs 43. The channel has an inside dimension $w^1$ approximately equal to the width w (FIG. 2) of the wall stud 20, and the centre spacing $t^1$ of the tabs 43 along the walls of the plate 22 is equal to the thickness t (FIG. 2) of the stud 20.

The notches 38 within the wall studs 20 are positioned and arranged such that, when the ends of the studs 20 are nested in the wall plates 22 and the terminal ends of the studs are in contact with the base walls 42 of the respective wall plates, the tabs 43 align with and engage in the notches 38 to hold the studs captive in the wall plates. Thus, each stud is held captive at four points at each ends of the stud, as shown in FIGS. 6 and 7.

FIG. 6 illustrates a method of fitting a single stud member to a wall plate 22, and FIG. 7 shows a method of fitting a pair of stud members (when connected to form a box section stud) to a wall plate 22. Both the stud members and the wall plates are formed, typically, from 0.8mm. thick steel, so the various elements can readily be sprung (i.e., elastically deformed) when locating them in desired interlocked positions.

The wall plate 22 is formed in its base 42 with a series of aligned slots 45, each such slot comprising a rectangular aperture 46 and an intersecting slit 47. The slots 45 are provided to receive tongues from lower T-connectors, linear connectors or right-angle connectors which are employed to interconnect aligned or intersecting wall frames.

Figure 8:
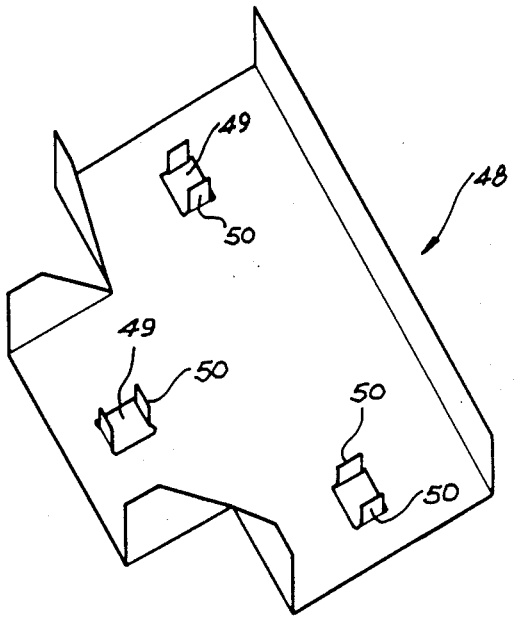
FIG. 8 shows a perspective view of a T-connector for interconnecting intersecting wall plates.
Figure 9:
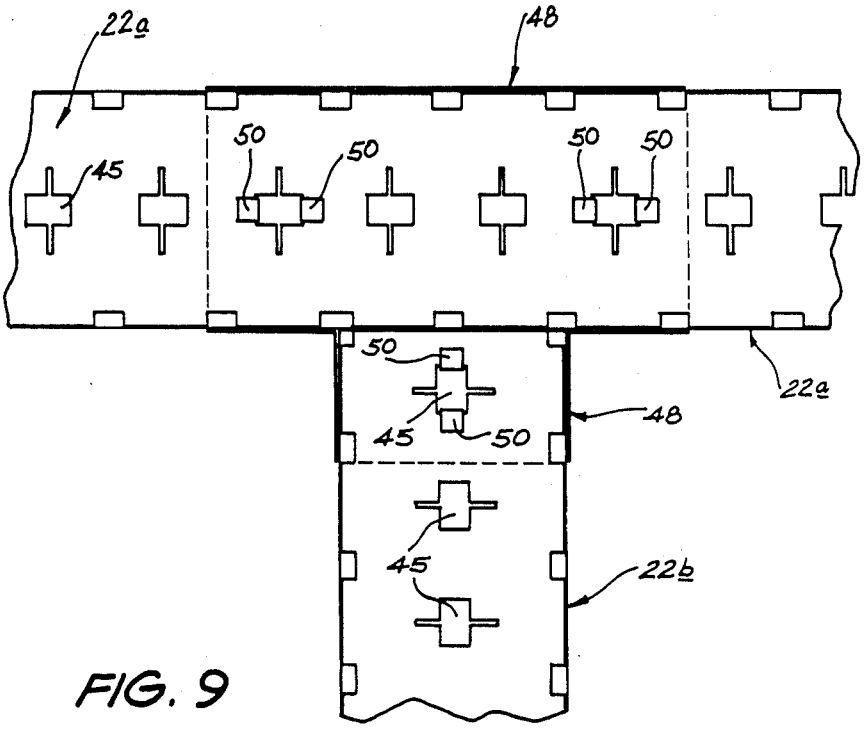
FIG. 9 shows a plan view of two intersecting wall plates when joined together by a T-connector.

FIG. 8 shows a typical T-connector 48 and it can be seen that it includes three apertures 49 which are punched to form upwardly projecting tongues 50. As shown in FIG. 9, intersecting floor plates 22*a* and 22*b* are laid within a T-connector 48, with the tongues 50 projecting through apertures 45 in the floor plates. When the intersecting floor plates are assembled as required, the tongues 50 are bent over to hold the floor plates captive to the T-connector.

Although not illustrated in the drawings, similar arrangements are provided for connecting two intersecting wall frames by way of a right-angle connector, for connecting two intersecting walls by way of a cruciform-shape connector, and for connecting two wall frames linearly by way of a channel-type connector. In all such connectors, tongues 50 will be provided for locating within apertures 45 in the wall plate 22.

The slots 45 which are provided within the top and bottom plats 21 and 22 are also employed for retaining terminal ends of the angle brace 27, as shown in FIG. 12 of the drawings. Thus, terminal ends 51*a* and 52*a* of brace strap portions 51 and 52 are first projected through the slits 47 and are then allowed to locate within the apertures 46 in the top and bottom plates 21 and 22. Thereafter, the entire brace is placed in tension by interconnecting two screwed connectors 53 and 54 by way of a turnbuckle 55.

Reference is now made to FIG. 11 of the drawings which shows a method of connecting trimmer studs 25 or 26 which are associated with window plates 23 or 24 to the wall studs 20, without there being any need to make a screwed or welded connection. Thus, the trimmer studs 25 and 26 are formed with tongues 56 and such tongues are positioned to align with the slots 40 in the wall studs 20. When a window size is determined and the various framing elements are located in the required position, the abutting trimmer studs and wall studs are interconnected by inserting and bending the tongues 52 through the apertures 40, so that both of the studs are held in a fixed position.

Reference is made finally to FIGS. 13 to 15 which show a method of interconnecting the wall studs 20 at a point mid-way along their length by way of a noggin strap 28. The noggin strap 28 is passed serially through each of the aligned apertures 39 in the wall studs 20 and, whereas the noggin strap is formed with a W-shaped section along a major portion of its length, at the point where the noggin strap passes through the web wall 32 of the wall studs 20, outer leg portions 57 of the noggin strap are slitted and folded outwardly to the position shown in dotted outline, whereby all of the studs which are spanned by a single noggin strap are interconnected by such strap.

I claim:

1. A metal wall-framing structure for a building, the wall-framing structure comprising: a horizontally disposed top plate, a horizontally disposed bottom plate and a plurality of vertically extending wall studs interconnecting the top and bottom plates; the top and bottom plates being substantially identical and each being in the form of a generally U-shaped channel having side walls, a base wall which interconnects the side walls and a plurality of paired inwardly directed tabs arrayed along each of the side walls, the tabs along each of the side walls being separate from one another, being disposed parallel to the base wall and each having a width significantly smaller than the space between adjacent tabs; the studs each having a generally C-shaped section formed by first and second parallel legs, a wall connecting the two legs and first and second inwardly directed flanges extending from the first and second legs respectively and disposed parallel to the connecting wall, each stud having a width between the first and second parallel legs which is approximately equal to the spacing between the side walls of the plates whereby the terminal ends of the studs may be nested within the channels defined by the plates, each stud having a thickness between the flanges and the connecting wall which is approximately equal to the centre spacing between adjacent tabs on each side wall of the plates, and each stud being formed with notches in each corner thereof adjacent the terminal ends of the stud, the notches being separate from one another in the form of apertures which extend only around respective corners of the stud and positioned such that, when the ends of each stud are located within the plates, the notches are engaged and the stud is constrained against moving by four adjacent ones of the tabs.

2. The structure as claimed in claim 1 wherein the successive tabs on each side wall of the top and bottom plates are spaced apart by equal distances.

3. The structure as claimed in claim 1 wherein the C-shaped section of each stud is asymmetrical whereby one said stud may be inverted relative to another identical said stud and be fitted to the other to form a box-section stud.

4. The structure as claimed in claim 1, wherein the first leg of each stud is slightly shorter in length than the second leg and the first flange of each stud has a length which is slightly less than that of the second flange.

5. The structure as claimed in claim 4 wherein the legs and connecting wall of each stud are fluted in the longitudinal direction of the stud.

6. The structure as claimed in claim 5 wherein the connecting wall of each stud is formed with at least two said flutes, wherein the flanges of each stud have a free edge which turns inwardly in a direction toward the connecting wall of the stud, and wherein, when two said studs are interfitted to form a box-section stud, one inwardly directed free edge of each stud engages in one of the flutes in the connecting wall of each other stud.

7. The structure as claimed claim 4 wherein the connecting wall of each stud is formed with at least one aperture and, at spaced apart intervals along the length of the stud, with a series of slots.

8. The structure as claimed in claim 7 wherein horizontally disposed upper and lower window plates are provided to extend parallel to the top and bottom plates and between two spaced-apart said studs, the upper and lower window plates being connected to the top and bottom plates respectively by trimmer studs.

9. The structure as claimed in claim 8 wherein each trimmer stud is formed adjacent each of its ends with notches which are engageable with the tabs in the top or bottom plates and with tabs which are similarly provided in the window plates, and wherein the trimmer studs are provided with deformable tongues which, when a trimmer stud is positioned adjacent a (main) stud, are engageable in the slots in the (main) stud.

10. The structure as claimed in claim 7 wherein a said aperture in provided in the connecting wall of each stud approximately mid-way along its length and wherein a metal noggin strap extends through the aperture in successive ones of the studs and interconnects the studs.

11. The structure as claimed in claim 1 wherein the base wall of the stop and bottom plates is formed with slots at spaced intervals along its length.

12. The structure as claimed in claim 11 and further including a connector element for interconnecting two or more of the top and bottom plates, the connector element having a channel-shaped section which is configured to receive the plates and the connector element being formed with tongues which are positioned to project through the slots in the base wall of each plate and which are arranged to be folded over to provide a positive connection between the connector element and the plates.

13. The structure as claimed in claim 11 wherein a diagonally extending brace element is provided to connect the upper and lower plates and wherein the brace element is connected to the respective plates by terminal ends of the brace element which extend through and are retained by the slots in the upper and lower plates.

* * * * *